US011877596B2

(12) United States Patent
Liu

(10) Patent No.: US 11,877,596 B2
(45) Date of Patent: Jan. 23, 2024

(54) ELECTRONIC CIGARETTE

(71) Applicant: Tuanfang Liu, Shenzhen (CN)

(72) Inventor: Tuanfang Liu, Shenzhen (CN)

( * ) Notice: Subject to any disclaimer, the term of this patent is extended or adjusted under 35 U.S.C. 154(b) by 1106 days.

(21) Appl. No.: 16/683,232

(22) Filed: Nov. 13, 2019

(65) Prior Publication Data

US 2020/0359708 A1 Nov. 19, 2020

(30) Foreign Application Priority Data

May 13, 2019 (CN) ..... 201910395136.X
May 13, 2019 (CN) ..... 201910400235.2
May 13, 2019 (CN) ..... 201920682809.5

(51) Int. Cl.
*A24F 40/40* (2020.01)

(52) U.S. Cl.
CPC ..... *A24F 40/40* (2020.01)

(58) Field of Classification Search
CPC ..... A24F 40/40; A24F 40/10
See application file for complete search history.

(56) References Cited

U.S. PATENT DOCUMENTS 9,999,245 B1 * 6/2018 Zhu ..... F16J 15/022
10,334,887 B1 * 7/2019 Qiu ..... A24F 40/49
2018/0092400 A1 * 4/2018 Sahin ..... A24F 40/30
2018/0153218 A1 * 6/2018 Verleur ..... A24F 40/485
2018/0177233 A1 * 6/2018 Tucker ..... A24F 40/30
2018/0303160 A1 * 10/2018 Davis ..... A24F 40/485
2019/0289909 A1 * 9/2019 Hejazi ..... A61M 15/0031
2020/0023155 A1 * 1/2020 Takehara ..... C25B 15/02
2020/0046022 A1 * 2/2020 Xiao ..... A24F 7/00
2020/0297035 A1 * 9/2020 Huang ..... A61M 11/042
2020/0345070 A1 * 11/2020 Ding ..... A24F 7/02

* cited by examiner

*Primary Examiner* — Truc T Nguyen

(74) *Attorney, Agent, or Firm* — MATTHIAS SCHOLL P.C.; Matthias Scholl

(57) ABSTRACT

An electronic cigarette, including: a mouthpiece cover; a housing; a battery; a silicone seal; a limit cover; a heating wire; a seat fixing the heating wire; a drain tube; an e-liquid filling pipe; a silicone sleeve; a plate including a pneumatic switch; and an end cover. The mouthpiece cover is disposed on the housing. The heating wire is fixed on the seat. The heating wire includes a pin which extends into the drain tube. The silicone seal sleeves the limit cover. The limit cover includes a groove and the heating wire is embedded in the groove. The limit cover is disposed on the seat. The drain tube and the e-liquid filling pipe are disposed in the seat. The pin of the heating wire is fixed on the plate. The plate includes a cathode and an anode which are connected to the battery. The silicone sleeve sleeves the plate.

1 Claim, 3 Drawing Sheets

ELECTRONIC CIGARETTE

CROSS-REFERENCE TO RELATED APPLICATIONS

Pursuant to 35 U.S.C. § 119 and the Paris Convention Treaty, this application claims foreign priority to Chinese Patent Application No. 201910395136.X filed May 13, 2019, to Chinese Patent Application No. 201910400235.2 filed May 13, 2019, and to Chinese Patent Application No. 201920682809.5 filed May 13, 2019. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, MA 02142.

BACKGROUND

The disclosure relates to an electronic cigarette.

Electronic cigarettes atomize nicotine-containing e-liquid.

Conventionally, the atomizing unit and the battery are disposed in one cavity. This leads to the risk of the e-liquid coming into direct contact with the battery.

SUMMARY

The disclosure provides an electronic cigarette.

The electronic cigarette comprises a mouthpiece cover; a housing; a battery; a silicone seal; a limit cover; a heating wire; a seat fixing the heating wire; a drain tube; an e-liquid filling pipe; a silicone sleeve; a plate comprising a pneumatic switch; and an end cover.

The mouthpiece cover is disposed on the housing; the heating wire is fixed on the seat; the heating wire comprises a pin which extends into the drain tube; the silicone seal sleeves the limit cover; the limit cover comprises a groove and the heating wire is embedded in the groove; the limit cover is disposed on the seat; the drain tube and the e-liquid filling pipe are disposed in the seat; the pin of the heating wire is fixed on the plate; the plate comprises a cathode and an anode which are connected to the battery; the silicone sleeve sleeves the plate; the silicone sleeve and the plate are disposed in the end cover; the end cover comprises a groove, and one end of the drain tube extends into the groove.

In nonuse of the electronic cigarette, the condensed e-liquid can flow along the drain tube into the groove of the end cover, thus preventing the e-liquid from penetrating to the battery and the pneumatic switch of the plate, and avoiding the occurrence of the short circuit.

DETAILED DESCRIPTION

Figure 1:
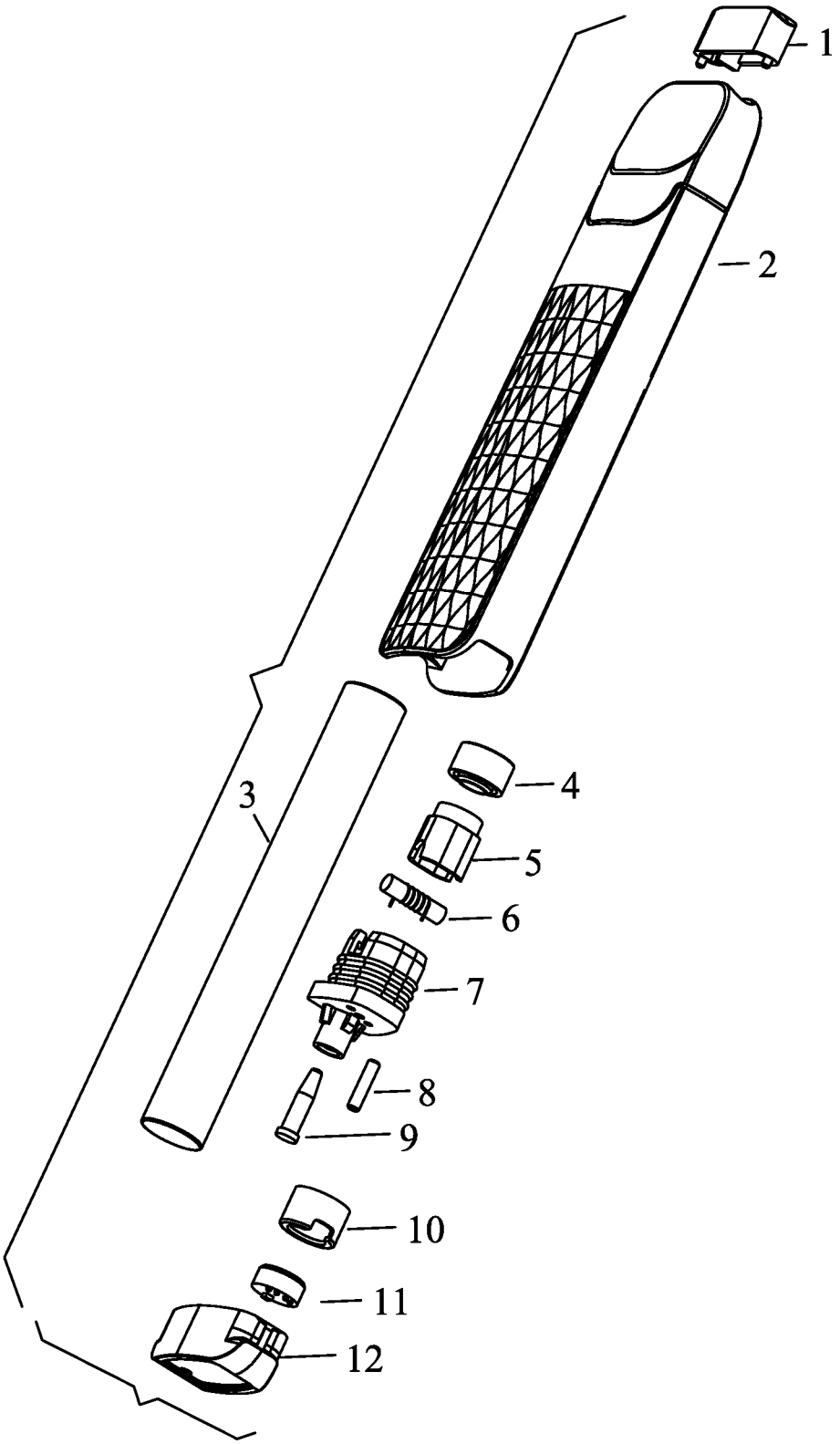
FIG. 1 is an exploded view of an electronic cigarette according to one embodiment of the disclosure.
Figure 2:
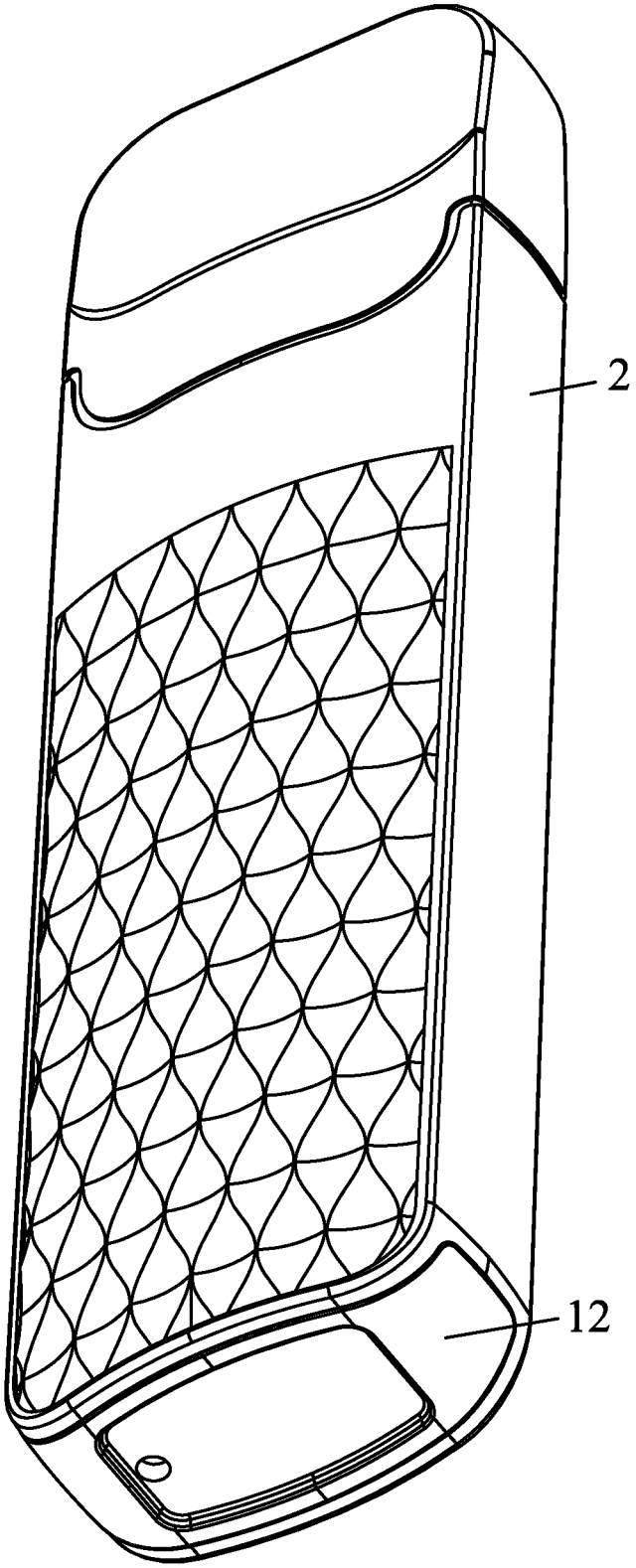
FIG. 2 is a schematic diagram of an electronic cigarette according to one embodiment of the disclosure.
Figure 3:
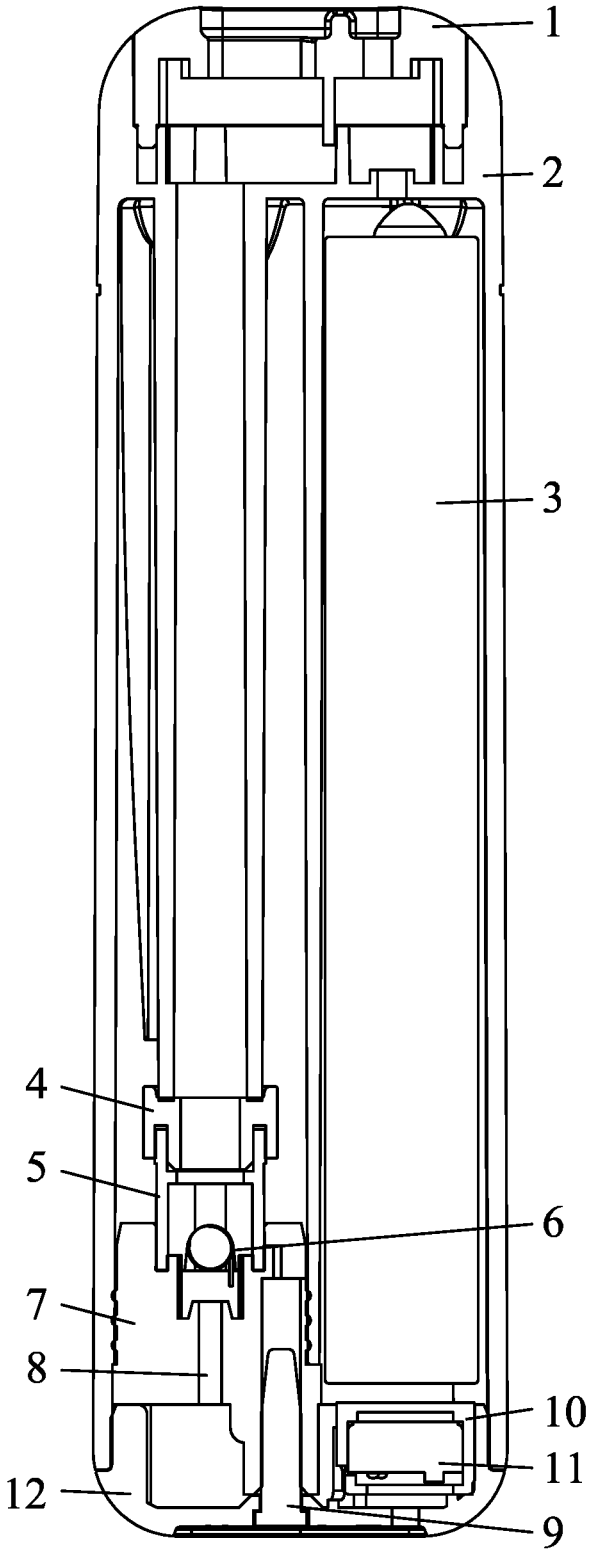
FIG. 3 is a sectional view of an electronic cigarette according to one embodiment of the disclosure.

To further illustrate, embodiments detailing an electronic cigarette are described below. It should be noted that the following embodiments are intended to describe and not to limit the disclosure.

An electronic cigarette comprises a mouthpiece cover 1; a housing 2; a battery 3; a silicone seal 4; a limit cover 5; a heating wire 6; a seat 7 fixing the heating wire; a drain tube 8; an e-liquid filling pipe 9; a silicone sleeve 10; a plate 11 comprising a pneumatic switch; and an end cover 12.

The mouthpiece cover 1 is disposed on the housing 2; the heating wire 6 is fixed on the seat 7; the heating wire 6 comprises a pin which extends into the drain tube 8; the silicone seal 4 sleeves the limit cover 5; the limit cover 5 comprises a groove and the heating wire 6 is embedded in the groove; the limit cover 5 is disposed on the seat 7; the drain tube 8 and the e-liquid filling pipe 9 are disposed in the seat 7; the pin of the heating wire 6 is fixed on the plate 11; the plate 11 comprises a cathode and an anode which are connected to the battery 3; the silicone sleeve 10 sleeves the plate 11; the silicone sleeve 10 and the plate 11 are disposed in the end cover 12; the end cover 12 comprises a groove, and one end of the drain tube extends into the groove.

In nonuse of the electronic cigarette, the condensed e-liquid can flow along the drain tube into the groove of the end cover, thus preventing the e-liquid from penetrating to the battery and the pneumatic switch of the plate, and avoiding the occurrence of the short circuit.

It will be obvious to those skilled in the art that changes and modifications may be made, and therefore, the aim in the appended claims is to cover all such changes and modifications.

What is claimed is:

1. A device, comprising:

1) a mouthpiece cover;

2) a housing;

3) a battery;

4) a silicone seal;

5) a limit cover;

6) a heating wire;

7) a seat fixing the heating wire;

8) a drain tube;

9) an e-liquid filling pipe;

10) a silicone sleeve;

11) a plate comprising a pneumatic switch; and 12) an end cover;

wherein:

the mouthpiece cover is disposed on the housing;

the heating wire is fixed on the seat;

the heating wire comprises a pin which extends into the drain tube;

the silicone seal sleeves the limit cover;

the limit cover comprises a groove and the heating wire is positioned in the groove;

the limit cover is disposed on the seat;

the drain tube and the e-liquid filling pipe are disposed in the seat;

the pin of the heating wire is fixed on the plate; the plate comprises a cathode and an anode which are connected to the battery;

the silicone sleeve sleeves the plate; the silicone sleeve and the plate are disposed in the end cover; and the end cover comprises a groove, and one end of the drain tube extends into the groove.

* * * * *